US012558589B2

(12) United States Patent
Klein

(10) Patent No.: US 12,558,589 B2
(45) Date of Patent: Feb. 24, 2026

(54) EXERCISE BENCH COMPRISING INDEPENDENTLY ADJUSTABLE HANDLE AND STABILIZER PAD

(71) Applicant: Joel B. Klein, Erie, PA (US)

(72) Inventor: Joel B. Klein, Erie, PA (US)

( * ) Notice: Subject to any disclaimer, the term of this patent is extended or adjusted under 35 U.S.C. 154(b) by 501 days.

(21) Appl. No.: 17/818,470

(22) Filed: Aug. 9, 2022

(65) Prior Publication Data

US 2023/0045004 A1 Feb. 9, 2023

Related U.S. Application Data

(60) Provisional application No. 63/230,916, filed on Aug. 9, 2021.

(51) Int. Cl.
*A63B 21/00* (2006.01)
*A63B 21/062* (2006.01)

(52) U.S. Cl.
CPC ..... *A63B 21/4029* (2015.10); *A63B 21/0626* (2015.10); *A63B 21/4003* (2015.10); *A63B 21/4007* (2015.10); *A63B 21/4035* (2015.10)

(58) Field of Classification Search
CPC ..... A63B 21/0626; A63B 21/4003; A63B 21/4007; A63B 21/0628; A63B 21/4005; A63B 21/4043; A63B 2225/093; A63B 21/4029–4035
See application file for complete search history.

(56) References Cited

U.S. PATENT DOCUMENTS 4,725,057 A 2/1988 Shifferaw
4,815,746 A 3/1989 Ward, Jr.
4,907,798 A * 3/1990 Burchatz ..... A63B 21/154 482/99
5,242,347 A * 9/1993 Keeton ..... A63B 21/063 482/142
5,665,041 A * 9/1997 Hsieh ..... A63B 23/0222 482/133

(Continued)

FOREIGN PATENT DOCUMENTS

CN 201437027 U 4/2010

OTHER PUBLICATIONS

DDS Blue Decline Sit Up Bench With Elastic Band, Carousell, accessed on Jan. 15, 2021, https://www.carousell.sg/p/dds-blue-decline-sit-up-bench-with-elastic-band-hg0027-34570355/. Product can also be found at https://www.alibaba.com/product-detail/gym-adjustable-foldable-abdominalexercise-used_62325365066.html?spm=a2700.7724857.0.0.5a0231af4nP4Yn.

(Continued)

*Primary Examiner* — Megan Anderson
*Assistant Examiner* — Catrina A Letterman
(74) *Attorney, Agent, or Firm* — Blynn L. Shideler; Krisanne Shideler; BLK Law Group

(57) ABSTRACT

A multipurpose workout bench and neck exercise system is used in a variety of exercises and possibly in conjunction with a cable weight system and/or cables attached to a head harness or chest harness. The workout bench includes an adjustable handle post and an adjustable stabilization post, each of which can be independently adjusted relative to the other with a pin securing mechanism, for example. The workout bench may further include a modular attachment portion configured to be attached to and detached from a corresponding workout component assembly.

16 Claims, 11 Drawing Sheets

(56) References Cited

U.S. PATENT DOCUMENTS

| | | | | |
|---|---|---|---|---|
| 6,168,557 | B1 * | 1/2001 | Liao | A63B 21/4047 482/142 |
| 6,547,704 | B2 * | 4/2003 | Parrillo | A63B 23/035 482/94 |
| 7,291,102 | B2 | 11/2007 | Mackert et al. | |
| 7,585,259 | B2 | 9/2009 | Turner | |
| 8,235,876 | B2 * | 8/2012 | Reyes | A63B 21/4029 482/145 |
| 8,449,438 | B2 * | 5/2013 | Morin | A63B 23/1218 482/142 |
| 8,696,528 | B2 | 4/2014 | Campanaro et al. | |
| 8,888,664 | B1 | 11/2014 | Butler | |
| 9,265,983 | B1 | 2/2016 | Bell | |
| 9,592,420 | B2 | 3/2017 | Noyes et al. | |
| D820,362 | S * | 6/2018 | Citterio | D21/687 |
| 10,456,614 | B1 * | 10/2019 | Dube | A63B 24/0062 |
| 10,675,499 | B2 | 6/2020 | Vorozilchak et al. | |
| 10,874,895 | B2 | 12/2020 | Isom | |
| D990,589 | S * | 6/2023 | Bo | D21/676 |
| 2002/0169057 | A1 * | 11/2002 | Forcillo | A63B 23/0227 482/142 |
| 2007/0083975 | A1 * | 4/2007 | Senegal | A63B 21/4017 2/102 |
| 2008/0064576 | A1 * | 3/2008 | Tyree | A63B 21/4007 482/129 |
| 2009/0215594 | A1 * | 8/2009 | Panaiotov | A63B 21/16 482/130 |
| 2014/0031182 | A1 * | 1/2014 | Donofrio | A63B 21/0552 482/129 |
| 2014/0113776 | A1 * | 4/2014 | Jaguan | A63B 22/0023 482/57 |
| 2015/0202484 | A1 * | 7/2015 | Lalaoua | A63B 23/0211 482/130 |

OTHER PUBLICATIONS

Gym Adjustable Foldable Abdominal Exercise, Alibaba, accessed on Jan. 18, 2021, https://www.alibaba.com/product-detail/gym-adjustable-foldable-abdominal-exercise-used_62325365066.html?spm=a2700.7724857.0.0.5a0231af4nP4Yn.

Multi-Press Dual Station, True Fitness, accessed on Jan. 15, 2021, https://truefitness.com/fr/commercial-fitness/multi-press/.

Inflight Multi Press Machine, Fitness Direct, accessed on Jan. 15, 2021, https://fitdir.com/inflighta-multi-press-machine-ct-mps/.

* cited by examiner

EXERCISE BENCH COMPRISING INDEPENDENTLY ADJUSTABLE HANDLE AND STABILIZER PAD

CROSS-REFERENCE TO RELATED APPLICATION

The present application claims the benefit of priority under 35 U.S.C. § 119(e) to U.S. Provisional Application No. 63/230,916, titled EXERCISE BENCH WITH CABLE CONNECTION MECHANISM, filed Aug. 9, 2021, which is incorporated by reference herein in its entirety.

SUMMARY

In one aspect of the present disclosure, a workout bench comprises a support base; an upright seat post extending from the support base; a seat supported by the upright seat post; and a vertical support post extending from the support base, wherein the vertical support post comprises: a plurality of height position holes and a cable connection mechanism coupled to a top of the vertical support post. The workout bench further comprises a sliding adjustment post comprising: an elongated hollow center post positioned around the vertical support post and configured to guide the sliding adjustment post along the vertical support post; a horizontal support post extending laterally from the elongated hollow center post; a stabilizing pad positioned around at least a portion of the horizontal support post; a handle extending from the horizontal support post; and a pin securing mechanism coupled to the elongated hollow center post and the vertical support post.

Yet in another aspect of the present disclosure, a system comprises an exercise bench comprising: a support base defining a centerline; an upright seat post extending from the centerline of the support base; a horizontal seat supported by the upright seat post; and a vertical support post extending from the centerline of the support base, wherein the vertical support post comprises: a plurality of height position holes. The exercise bench further comprises a connection mechanism extending from a top of the vertical support post and aligned with the centerline of the support base. The system further comprises a harness comprising a strap and a resistance system selectively coupled to the connection mechanism and the harness.

Yet in another aspect of the present disclosure, a workout bench comprises a support base, an upright seat post extending from the support base, a seat supported by the upright seat post, and a vertical support post extending from the support base. The vertical support post comprises a plurality of height position holes, a first sliding adjustment post comprising a first elongated hollow center post positioned around the vertical support post and configured to guide the first sliding adjustment post along the vertical support post, a first horizontal post extending laterally from the first elongated hollow center post, a stabilizing pad positioned around at least a portion of the first horizontal post, and a first pin securing mechanism coupled to the first elongated hollow center post and the vertical support post. The workout bench further comprises a second sliding adjustment post configured to slide independent of the first sliding adjustment post, wherein the second sliding adjustment post comprises a second elongated hollow center post positioned around the vertical support post and configured to guide the second sliding adjustment post along the vertical support post, a second horizontal post extending laterally from the second elongated hollow center post, wherein the second horizontal post comprises at least one graspable handle portion, and a second pin securing mechanism coupled to the second elongated hollow center post and the vertical support post.

BRIEF DESCRIPTION OF THE DRAWINGS

The novel features of the various aspects are set forth with particularity in the appended claims. The described aspects, however, both as to organization and methods of operation, may be best understood by reference to the following description, taken in conjunction with the accompanying drawings in which:

DETAILED DESCRIPTION

The Applicant also owns U.S. Design patent application Ser. No. 29/802,838, titled WORKOUT BENCH, which was filed on Aug. 9, 2021 and is incorporated by reference herein in its entirety.

Before explaining various aspects of workout benches and exercises in detail, it should be noted that the illustrative examples are not limited in application or use to the details of construction and arrangement of parts illustrated in the accompanying drawings and description. The illustrative examples may be implemented or incorporated in other aspects, variations, and modifications, and may be practiced or carried out in various ways. Further, unless otherwise indicated, the terms and expressions employed herein have been chosen for the purpose of describing the illustrative examples for the convenience of the reader and are not for the purpose of limitation thereof. Also, it will be appreciated that one or more of the following-described aspects, expressions of aspects, and/or examples, can be combined with any one or more of the other following-described aspects, expressions of aspects, and/or examples.

The present application discloses an apparatus for performing various exercises with a workout bench and an attachable cable/harness, such as neck strengthening exercises and assisted hamstring curls, for example. In certain instances, the apparatus includes an exercise bench that can be used in conjunction with a neck strengthening system, such as a headgear assembly and a cable weight system. The apparatus can also be used to perform neck exercises without the cable weight system in other instances. In various instances, the apparatus includes a workout bench that can be used in conjunction with weighted assistance for hamstring curls, such as a vest or chest harness having attachable straps. The apparatus further provides alternative exercise functionality that allows a user to perform lat pull-downs and single leg Bulgarian split squats, as well as sit-ups in various instances.

Figure 1:
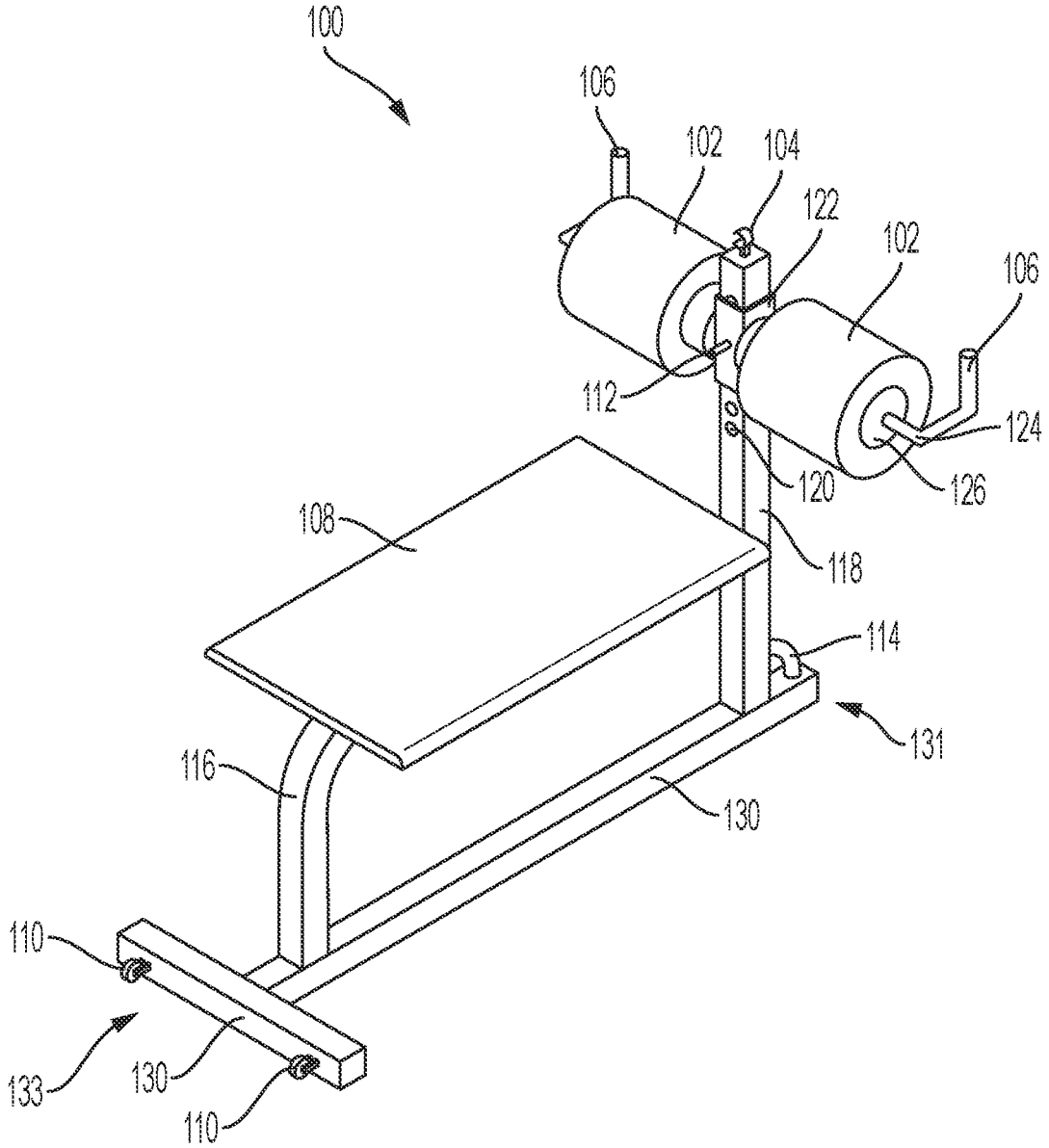
FIG. 1 illustrates an exercise bench, in accordance with at least one aspect of the present disclosure.
Figure 2:
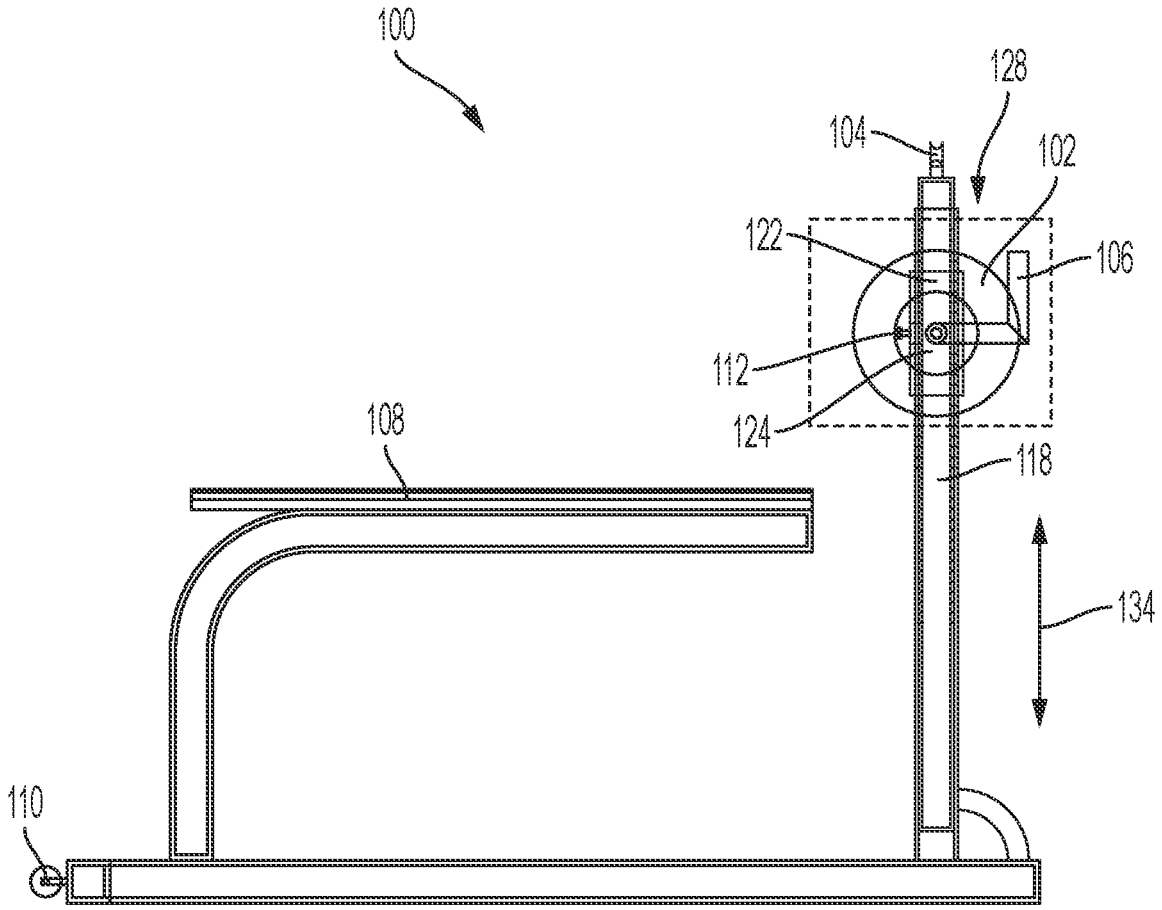
FIG. 2 illustrates a side view of the exercise bench of FIG. 1, in accordance with at least one aspect of the present disclosure.

Referring primarily to FIGS. 1 and 2, an exercise bench 100 is shown. The exercise bench 100 includes two stabilizing pads 102, two handle grips 106, a cable connection mechanism 104, a seat pad 108, a vertical support post 118, and a support base 130. The support base 130 includes a main base member extending longitudinally from a proximal or first end 131 of the workout bench 100 to a distal end or rear end 133 of the workout bench 100 along a longitudinal centerline of the workout bench 100 and is coupled to an upright seat post 116 and to the vertical support post 118. A first end 131 of the exercise bench 100 includes a buttress-style handle 114 at the 90-degree junction where the vertical support post 118 meets the support base 130. The buttress-style handle 114 allows a user to easily move the exercise bench 100 by picking up the first end 131 and rolling the wheels 110 on a first cross support extending perpendicular to the main base member at a position toward the distal or rear end 133 from a center-point along the main base member of the exercise bench 100 along a floor or other support surface.

FIG. 1 shows the support base 130 as a 'T' shape. The reader will readily appreciate that the support base 130 can also be configured in another configuration to support a dynamic load such as the body weight of a user such as an 'H' shape, for example or. Additionally, FIG. 1 shows the seat post 116 as a shape, however, the reader will readily appreciate that the seat post 116 can also be configured in another configuration to support a dynamic load such as the body weight of a user, such as an 'L' or a straight support post, for example. Additionally, as shown in workbench 200 of FIG. 5 the seat post 16 can be formed as a first upright seat post 116 extending from the main base member of the support base 130 at a position toward the distal end of the workout bench 200 from a center-point along the main base member, and a second upright seat post 116 extending from the main base member at a position toward the proximal end of the workout bench 200 from a center-point along the main base member.

A detailed view of a sliding adjustment post 128 is shown in FIG. 2. The sliding adjustment post 128 includes an elongated hollow center post 122, two horizontal support posts 124, two stabilizing pads 102, two end caps 126, two handle grips 106 at the distal ends of the sliding adjustment post 128, and a pin securing mechanism 112. The horizontal support posts 124 are coupled to opposite ends of the elongated hollow center post 122. The stabilizing pads 102 are configured to cover length-wise perimeter portions of the horizontal support posts 124, and the stabilizing pads 102 are secured in place by the end caps 126. The horizontal support posts 124 intersect the center of each of the end caps 126, and continue laterally outward from the center of the sliding adjustment post 128. The distal ends of the horizontal support posts 124 are coupled to the handle grips 106. The handle grips 106 include an L-shape with each handle grip defining a first arm extending orthogonally away from the horizontal support post 124 toward the front end 131 and a second arm extending upwards and orthogonally away from the first arm upward.

The sliding adjustment post 128 is configured to slide in a vertical direction 134. The sliding adjustment post 128 can be raised and lowered by the user to allow the stabilizing pads 102 to rest firmly on each of the user's quadriceps in certain instances, such as when the user is seated on the seat pad 108 facing the front end 131 (see FIG. 3). The seat pad 108 extends longitudinally in the same direction and orientation as the support base 130. For example, the seat pad 108 and the support base 130 can be parallel or substantially parallel. In certain instances, the seat pad 108 and/or the support base 130 can be parallel to the floor or support surface for the workout bench 100.

The elongated hollow center post 122 is configured to fit securely around the vertical support post 118, which allows the vertical support post 118 to guide the sliding adjustment post 128 along the vertical axis 134. The elongated hollow center post 122 is configured to be slightly larger than the exterior dimensions of the vertical support post 118. The dimensions of the elongated hollow center post 122 allow the sliding adjustment post 128 to move along the vertical axis 134 with minimal friction from the contact with the vertical support post 118. In certain instances, a lubricant can be applied to further facilitate smooth sliding motion between the elongated hollow center post 122 and the vertical support post 118. The dimensional difference between the elongated hollow center post 128 and the vertical support post 118 is sufficiently small enough to prevent the sliding adjustment post 128 from vibrating when the selected height position is locked in place by a pin securing mechanism 112.

The sliding adjustment post 128 is locked in place by using the pin securing mechanism 112 in one of the plurality of height position holes 120 of the vertical support post 118. For example, the pin can be securely position through aligned through-holes in the elongated hollow center post 122 and the vertical support post 118 (e.g. the height position holes 120). A user may adjust the height position of the stabilizing pads 102 by moving the elongated hollow center post 122 in the vertical direction 134. The user may unlock the sliding adjustment post 128 by removing or releasing the tension of the pin securing mechanism 112. Once the sliding adjustment post 128 is unlocked, it can be freely moved along the vertical axis 134. A user selects a height position by locking the pin securing mechanism 112 in one of the plurality of height position holes 120. Once the pin securing mechanism 112 is locked, the sliding adjustment post 128 is no longer able to move along the vertical axis 134 until the user unlocks the pin securing mechanism 112.

The exercise bench 100 includes a cable connection mechanism 104 coupled to the top of the vertical support post 118. For example, a user can connect a cable to the cable connection mechanism 104 to position the cable in a desired direction relative to a connection point 156. For example, a cable can extend from the connection point 156 on a head-harness 154 or a chest harness to the cable connection mechanism 104, which can provide a quick connect/disconnect feature for securing the cable. Discussed in greater detail below, any suitable device for attaching the user to the cable machine can be used such as, for example, a belt, straps, etc. The cable connection mechanism 104 allows a user to easily connect and disconnect a cable and/or cable weight system 150. In various instances, the cable can be a non-stretchable strap. Various straps can be rated to 2000 pounds of tension, for example, and can include carabineer clips on either end. In certain instances, one or more additional straps with training grips can be coupled to the strap at the clip(s).

Figure 3:
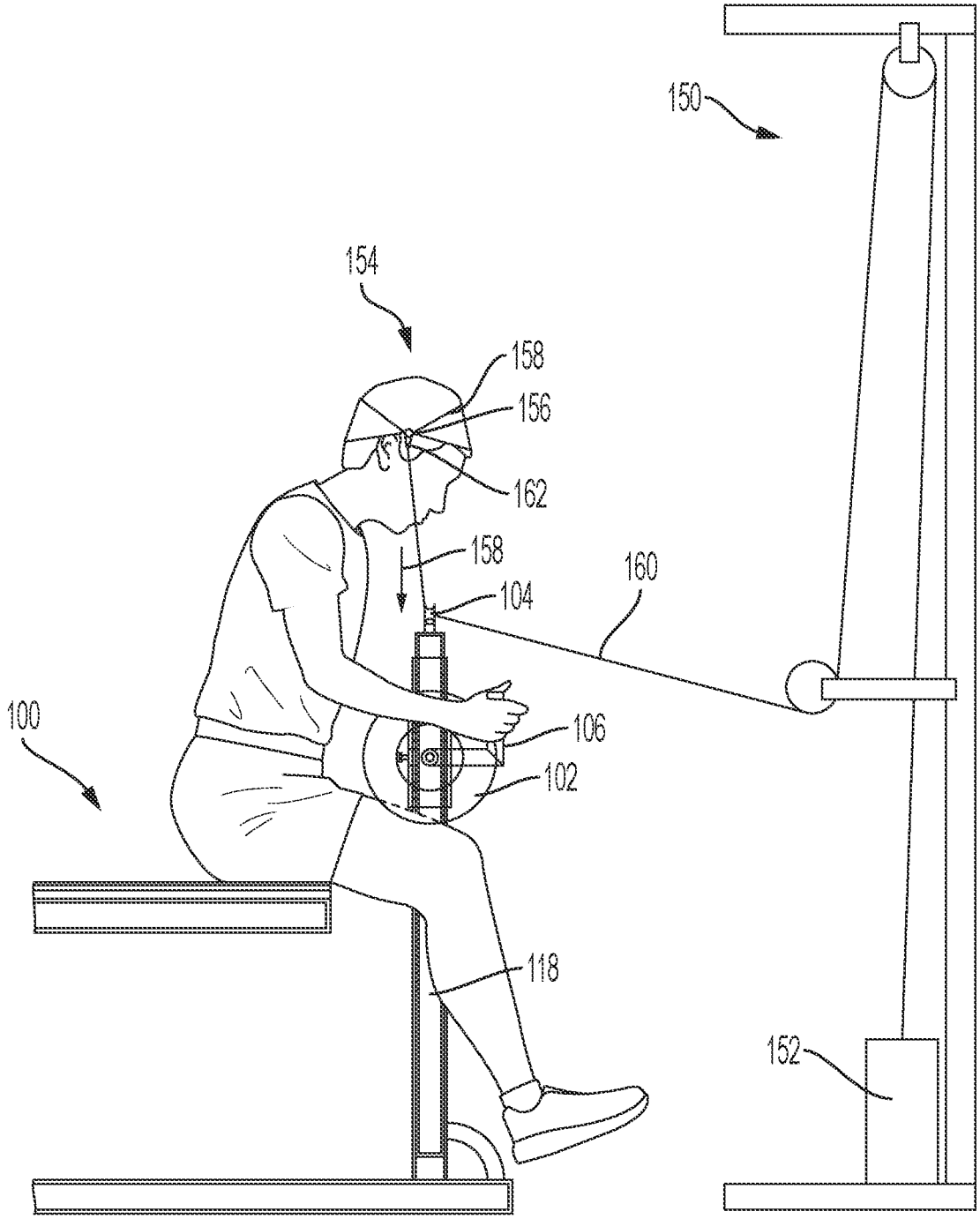
FIG. 3 illustrates a user operating the exercise bench of FIG. 1 in connection with a cable weight system, in accordance with at least one aspect of the present disclosure.

A user can sit at the exercise bench 100 facing toward or away from the handles 106, depending on the exercise being performed. For example, while performing neck training, the user can face the handles 106 while utilizing the cable attachment mechanism 104 for holding a cable, such as the D-rings/chain extending from a head harness to strengthen the neck muscles. FIG. 3 illustrates a user operating the exercise bench 100 in connection with a cable weight system 150 for performing neck strengthening exercises.

In certain instances, the user may also use the cable weight system 150 to perform a non-neck exercise and it is advantageous to rapidly connect and disconnect the exercise bench 100 to perform different exercises. For example, while performing Nordic hamstring curls and other hamstring exercises, the user can face away from the handles 106 and use the cable attachment mechanism 104 to hold and guide the cable, such as a cable attached to an exercise vest or chest harness, which can assist the user in performing these exercises (e.g. assisted Nordic hamstring curls).

In certain instances, the cable connection mechanism 104 can include a spring-loaded portion such as a carabineer clip, for example, that opens and closes. In certain aspects of the present disclosure, the cable connection mechanism 104 can include an incomplete circular loop ("C-shaped") with a small opening at the base of the loop that is slightly larger than the diameter of the cable 160 but smaller than a terminated end 162 of the cable 160. The cable connection mechanism 104 routes the terminated end 162 of the cable 160 to the head-harness 154 and allows the terminated end 162 to connect to a connection point 156 of the head-harness 154 or chest harness, for example. The cable routing functionality of the cable connection mechanism 104 allows the cable weight system 150 to apply different dynamic loads from various angles, such as in a downward vertical direction 158, for example.

When a user has completed a set of neck exercise repetitions, the user may disconnect/release the terminated end 162 of the cable 160 from the head-harness 154 or chest harness. The terminated end 162 is larger than the diameter of the cable connection mechanism 104 and allows the terminated end 162 to rest at the cable connection mechanism 104 when the user is not using the cable system.

Figure 4:
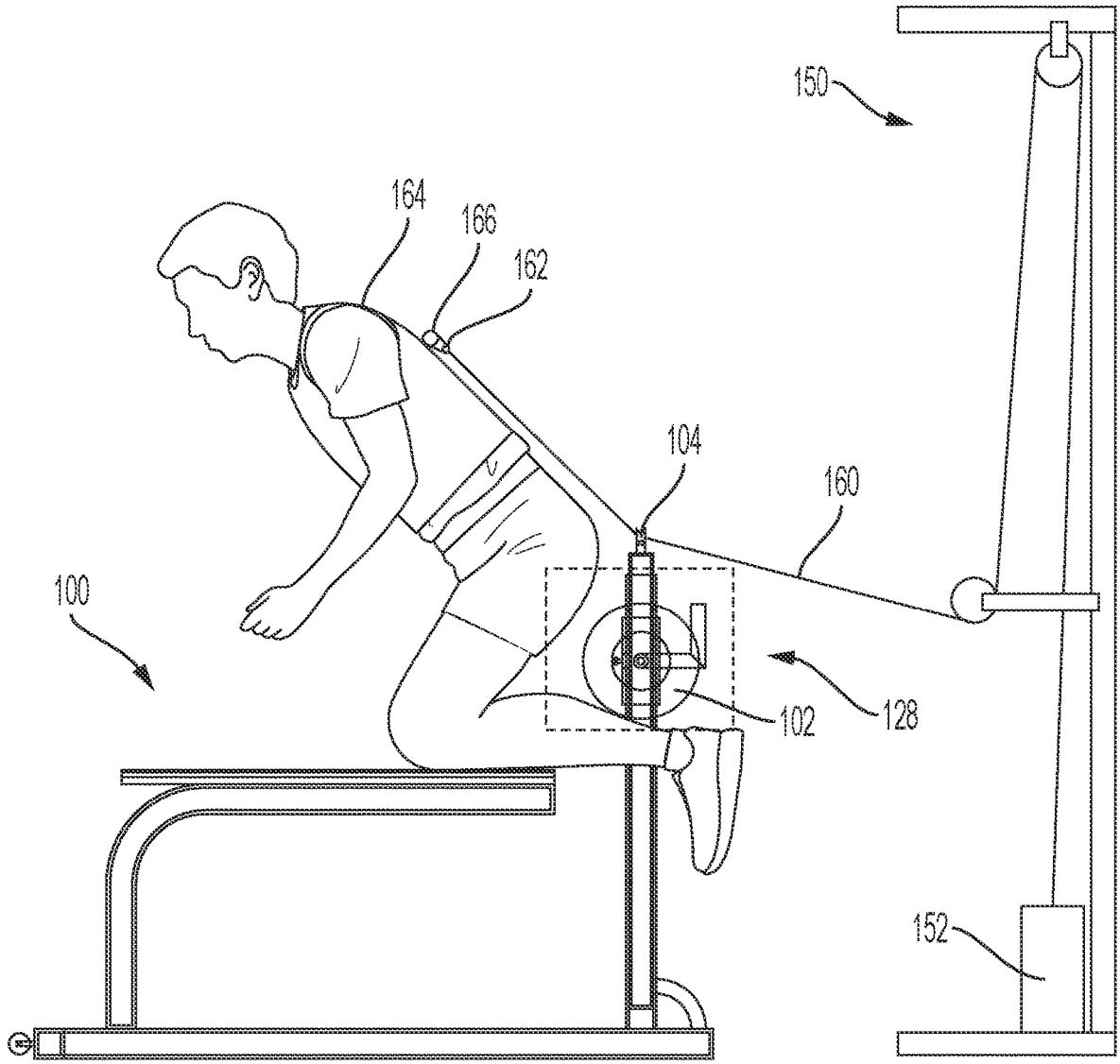
FIG. 4 illustrates an alternative user position for the exercise bench of FIG. 1, in accordance with at least one aspect of the present disclosure.

FIG. 4 illustrates an alternative user position for the exercise bench of FIG. 1, in accordance with at least one aspect of the present disclosure. FIG. 4 depicts a user performing a hamstring curl exercise on the exercise bench 100 by placing their knees on the seat 108, and adjusting the sliding adjustment post 128 so that the stabilizing pad 102 rests firmly on the user's calves. While performing Nordic hamstring curls and other hamstring exercises, the user can face away from the handles and use the cable attachment mechanism 104 to hold the cable 160, such as the straps coupled to an exercise vest 164 or harness at a connection point 166 to help assist the user in performing these exercises. Discussed in greater detail below, any suitable device for attaching the user to the cable machine can be used such as, for example, a belt, straps, etc.

Figure 5:
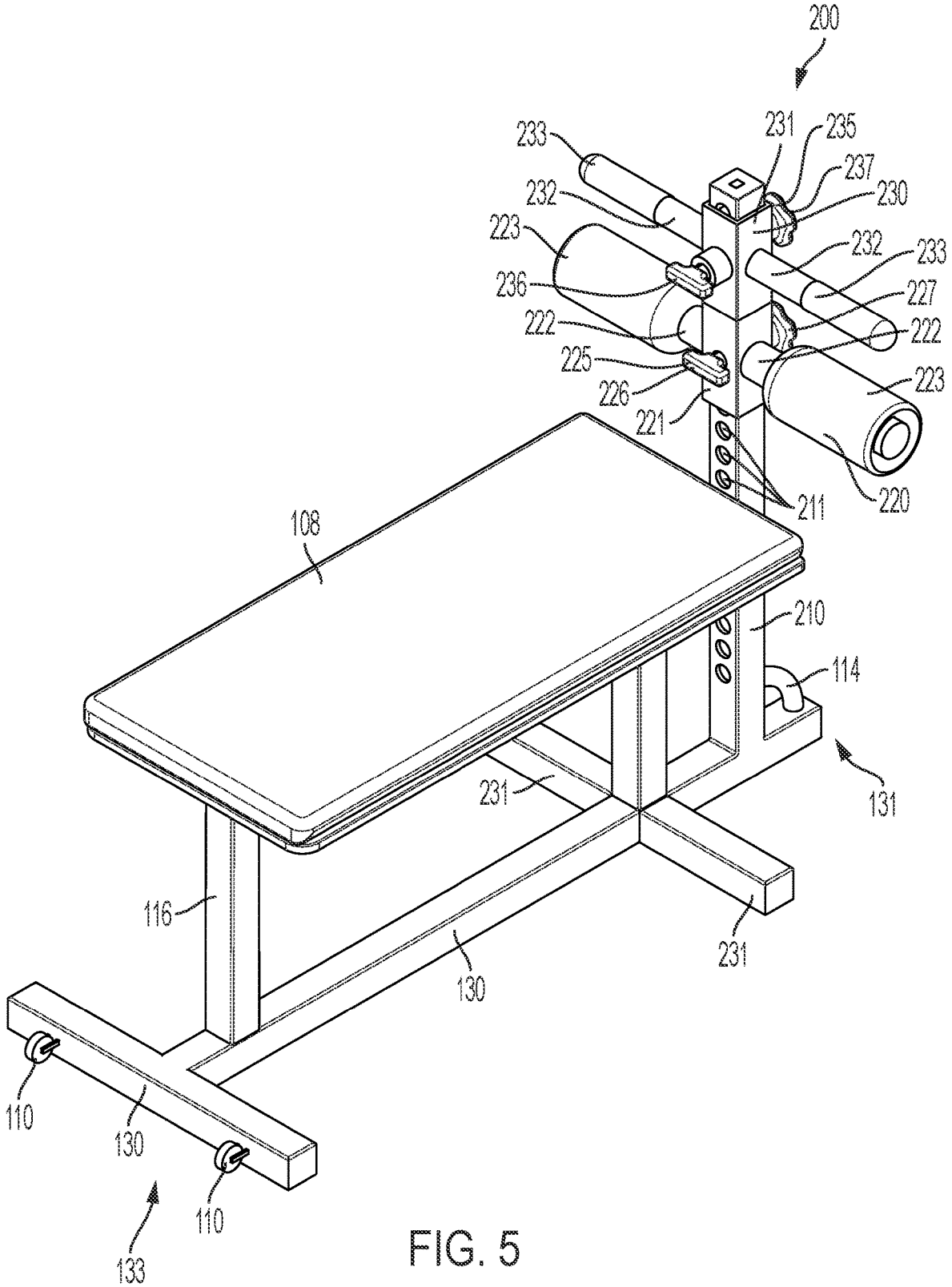
FIG. 5 is a perspective view of a workout bench comprising an adjustable handle and an adjustable stabilizer, in accordance with at least one aspect of the present disclosure.
Figure 6:
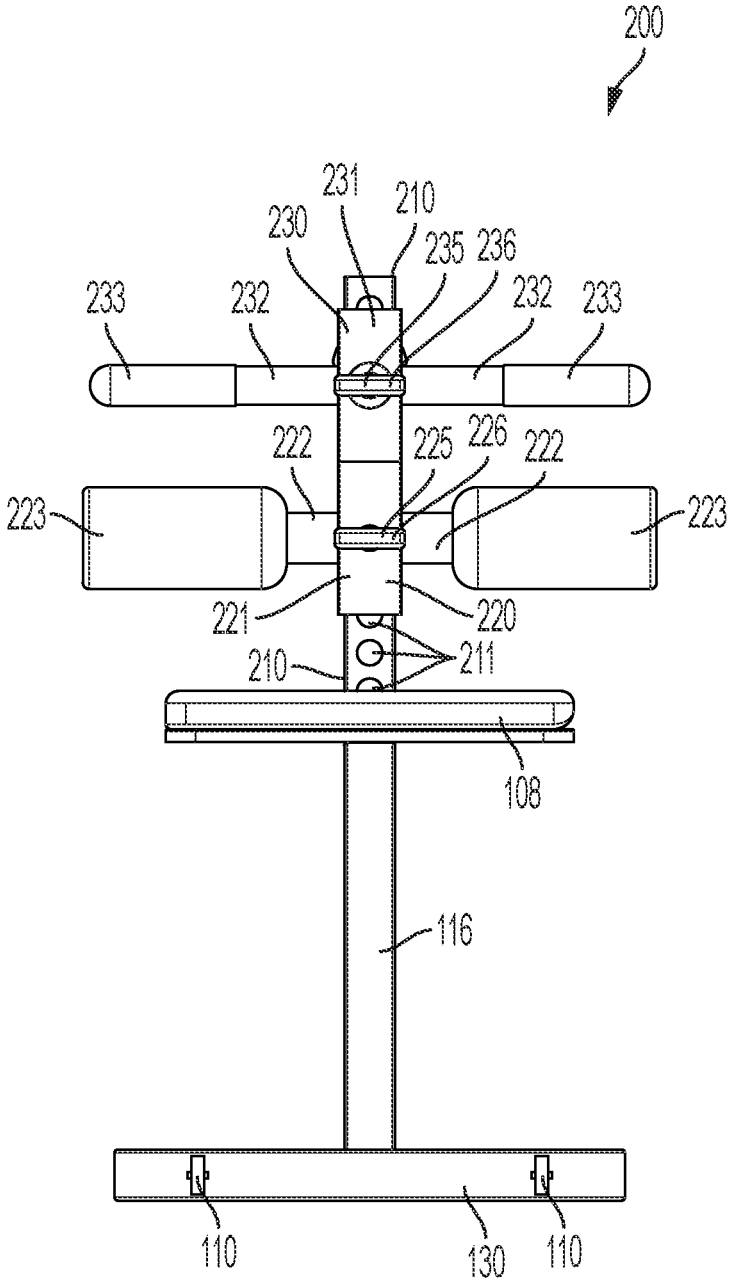
FIG. 6 is a rear elevational view of the workout bench of FIG. 5, in accordance with at least one aspect of the present disclosure.
Figure 7:
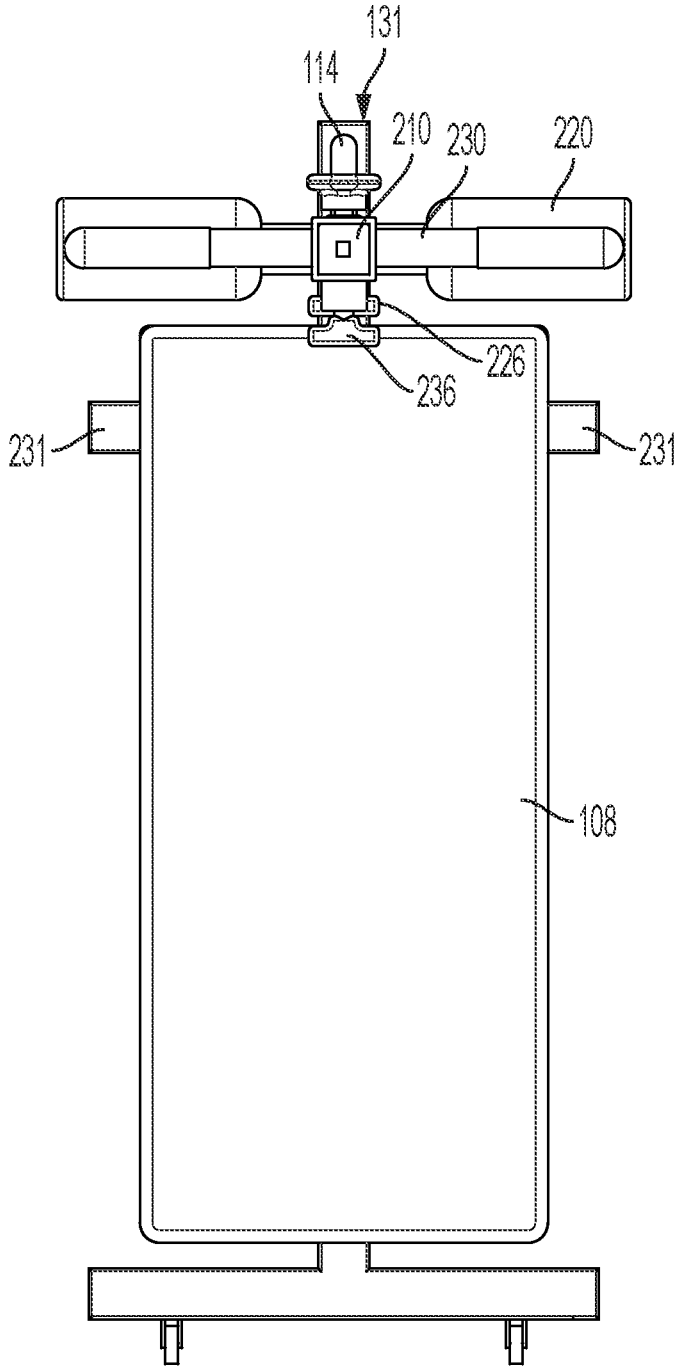
FIG. 7 is a top plan view of the workout bench of FIG. 5, in accordance with at least one aspect of the present disclosure.

FIGS. 5-7 depict an exercise bench 200. The exercise bench 200 is similar in many respects to the exercise bench 100. Differences between exercise bench 100 and exercise bench 200 are further explained below. The exercise bench 200 further comprises lateral support members 231 extending from the support base 130 toward the vertical support post, wherein the lateral support members 231 form a second cross support extending perpendicular to the main base member at a position toward the proximal end of the workout bench 200 from a center-point along the main base member. Such support members 231 may aid in stabilizing the exercise bench 200 during use, for example.

The exercise bench 200 further comprises a vertical support post 210 extending vertically from the support base 130. The vertical support post 210 comprises a plurality of through hole apertures 211 defined therein extending through a first side of the support post 210 and a second side of the support post 210 opposite the first side. The exercise bench 200 further comprises an adjustable stabilizer pad assembly 220 and an adjustable handle assembly 230. Each assembly 220, 230 is independently adjustable relative to the other assembly 220, 230. The adjustable stabilizer pad assembly 220 is positioned below the handle assembly 230, however, the adjustable stabilizer pad assembly 220 may also be positioned above the handle assembly 230.

The stabilizer pad assembly 220 comprises a hollow center post 221 slidably supported by the support post 210, laterally extending support posts 222 extending outwardly from the center post 221, and stabilizer pads 223 positioned around the laterally extending support posts 222. The stabilizer pad assembly 220 further comprises a pin securing mechanism 225 configured to permit a user to fix the position of the stabilizer pad assembly 220 relative to the support post 210 at the desired height. The pin securing mechanism 225 comprises a pin 226 configured to extend through the center post 221 and any of the through hole apertures 211 in the support post 210 thereby coupling the stabilizer pad assembly 220 to the support post 210. The pin securing mechanism 225 further comprises a knob 227. In at least one instance, the knob 227 is fixedly attached to the center post 221 so as to provide a user with a place to grasp the stabilizer pad assembly 220 during adjustment of the stabilizer pad assembly 220 relative to the support post 210. In at least one instance, the knob 227 is couplable, or attachable, to the pin 226 so as to provide a more secure engagement between the stabilizer pad assembly 220 and the support post 210. For example, the knob 227 may be threaded onto an end of the pin 226. In another example, the knob 227 may be secured to the pin 226 by way of a secondary pin. In yet another example, the knob 227 may be secured to the pin 226 using a quick release coupling comprising, for example, a spring and ball bearing design. In at least one instance, the pin 226 is spring loaded.

The stabilizer pads 223 may also be considered knee pads and can be positioned so as to provide support for a user's knees and/or upper thighs, for example.

The adjustable handle assembly 230 comprises a hollow center post 231 slidably supported by the support post 210, laterally extending support posts 232 extending outwardly from the center post 231, and graspable handle portions 233 positioned around the laterally extending support posts 232. The adjustable handle assembly 230 further comprises a pin securing mechanism 235 configured to permit a user to fix the position of the adjustable handle assembly 230 relative to the support post 210 and relative to the stabilizer pad assembly 220 at the desired height. The pin securing mechanism 235 comprises a pin 236 configured to extend through the center post 231 and any of the through hole apertures 211 in the support post 210 thereby coupling the adjustable handle assembly 230 to the support post 210. The pin securing mechanism 235 further comprises a knob 237. In at least one instance, the knob 237 is fixedly attached to the center post 231 so as to provide a user with a place to grasp the adjustable handle assembly 230 during adjustment of the adjustable handle assembly 230 relative to the support post 210. In at least one instance, the knob 237 is couplable, or attachable, to the pin 236 so as to provide a more secure engagement between the adjustable handle assembly 230 and the support post 210. For example, the knob 237 may be threaded onto an end of the pin 236. In another example, the knob 237 may be secured to the pin 236 by way of a secondary pin. In yet another example, the knob 237 may be secured to pin 236 using a quick release coupling comprising, for example, a spring and ball bearing design. In at least one instance, the pin 236 is spring loaded.

The adjustable handle assembly 230 and the adjustable stabilizer pad assembly 220 are slidable relative to and adjustable relative to the support post 210. The adjustable handle assembly 230 and the adjustable stabilizer pad assembly 220 are also slidable relative to and adjustable relative to each other. The adjustable stabilizer pad assembly 220 can be used to provide leverage to a user when in certain workout positions. The adjustable handle assembly 230 can additionally be used to provide leverage to user through grasping the handle assembly 230 with a user's hands when in certain workout positions. Being able to adjust each assembly 220, 230 independently of each other and relative to the support post 210 can allow a user to maximize efficiency, ergonomics, and comfortability of the workout bench 210 to accommodate users varying in size, stature, ability, and/or flexibility, for example. Such a configuration can also allow a user to fine tune the workout bench 200 so as to provide maximum and/or minimum resistance in certain parts of a specific workout. Such adjustability of the stabilizer pads 223 and the handle assembly 220 can improve the stability of a user's base, decrease a moment arm for certain exercises, allow a user to use more weight in particular exercises, and/or allow a user to isolate targeted muscles. For example, during a neck strengthening exercise, holding the handles of the handle assembly can stabilize the torso and reduce the moment arm.

Figure 8:
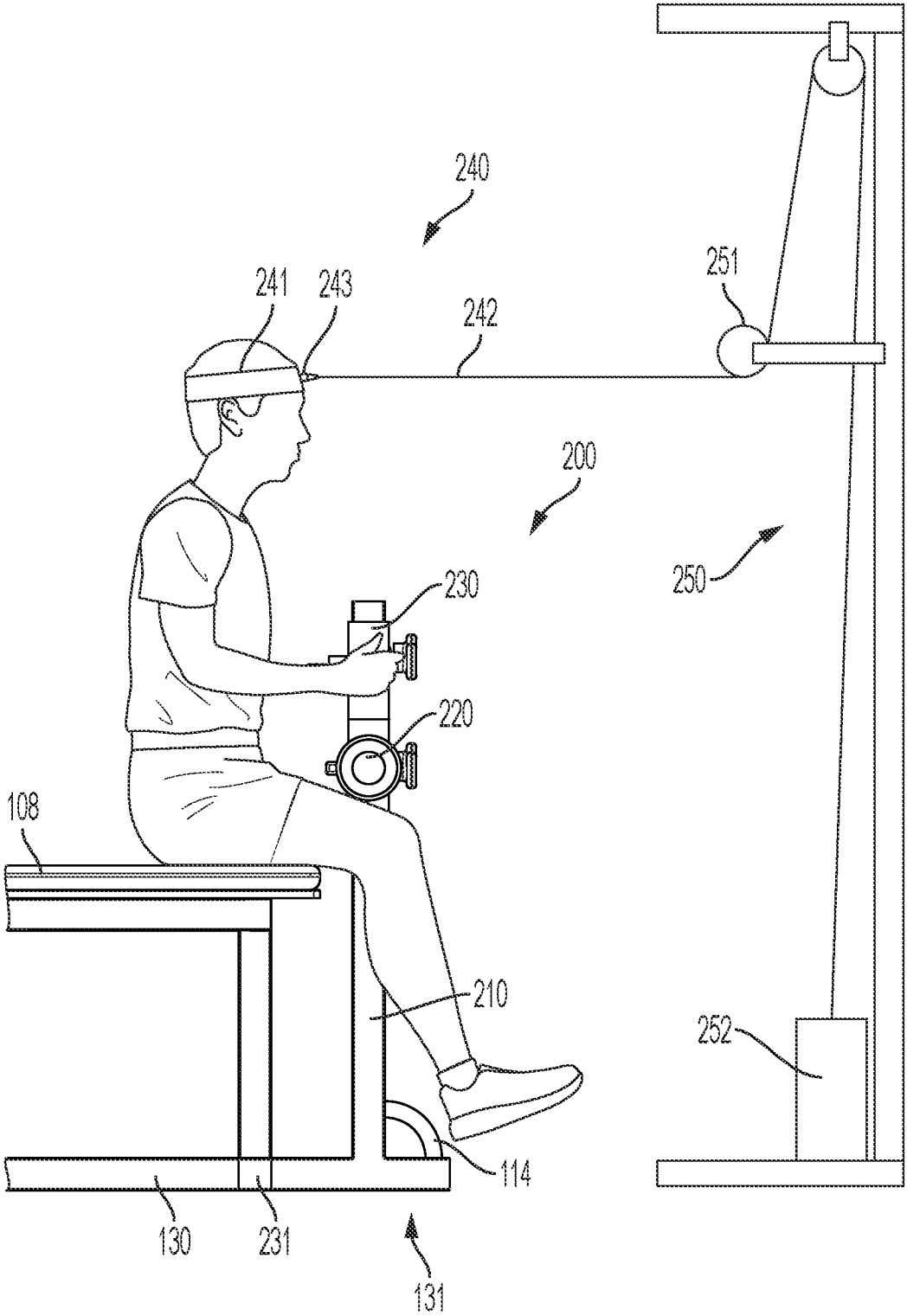
FIG. 8 illustrates a user operating the workout bench of FIG. 5 in connection with a cable weight system in a first user position, in accordance with at least one aspect of the present disclosure.

FIG. 8 illustrates a user operating the exercise bench 200 in connection with a cable weight system 250 for performing neck strengthening exercises. A head-harness 240 is coupled to a cable 242 at connection mechanism 243. Discussed in greater detail below, any suitable device for attaching the user to the cable machine can be used such as, for example, a belt, straps, etc. The cable 242 is at least substantially parallel to the seat pad 108. In at least one instance, substantially parallel indicates that the cable 242 is within about 5 degrees of parallel in either direction, about 10 degrees of parallel either direction, 15 degrees of parallel either direction, 20 degrees of parallel either direction, 25 degrees of parallel either direction, and/or 30 degrees of parallel either direction, for example. In at least one instance, the cable 242 being at least substantially parallel to the seat pad 108 provides maximum resistance and/or assistance for neck strengthening exercises.

Figure 9:
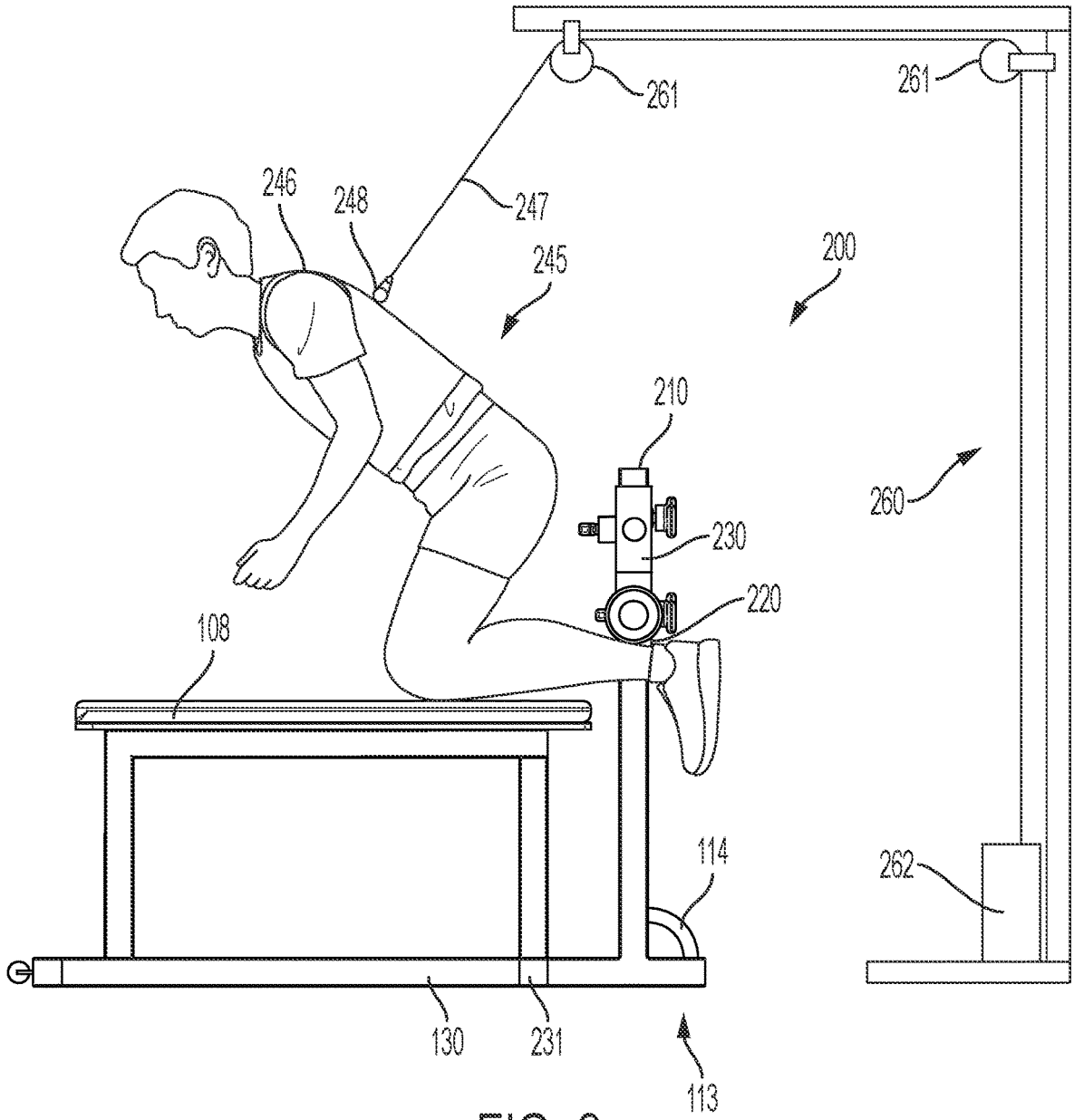
FIG. 9 illustrates a user operating the workout bench of FIG. 5 in connection with a cable weight system in a second user position, in accordance with at least one aspect of the present disclosure.

FIG. 9 illustrates another user position for the workout bench 200, in accordance with at least one aspect of the present disclosure. The user is performing a hamstring curl exercise on the exercise bench 200 by placing their knees on the seat 108, and adjusting the adjustable stabilizer pad assembly 220 so that the stabilizing pads 223 rest firmly on the user's calves. While performing Nordic hamstring curls and other hamstring exercises, the user can face away from the handles 233 and utilize an exercise vest, or harness, assembly 245 to help assist the user in performing these exercises. Discussed in greater detail below, any suitable device for attaching the user to the cable machine can be used such as, for example, a belt, straps, etc. The harness assembly 245 comprises a vest 246, a cable 247, and a connection mechanism 248 permitting attachment of the cable 247 to the vest 246. The cable 247 can be coupled to, or a unitary part of, of a cable weight system 260. The cable weight system 260 comprises a weight 262, pulley wheels 261. The cable 247 is attached to the weight 262 so as to provide a force to the user during the exercise. In at least one instance, the force can comprise both an assisting force to a user during a portion of the exercise and a resisting force to the user during the exercise. In at least one instance, the workout bench 200 provides maximum assistance at the most difficult part of the hamstring curl exercise. In other words, when the user is at the bottom of the hamstring curl exercise, it may be difficult to get back to the top of the hamstring curl exercise. The workout bench 200 may permit the greatest assistance to user when the user in at the bottom of the hamstring curl exercise. In at least one instance, this provides a user who may not have been able to perform such an exercise before the ability to now perform the exercise. In at least one instance, the workout bench 200 permits the cable 247 to be significantly more toward perpendicular to the seat pad 108 while the user is at the bottom of the hamstring curl exercise. In at least one instance, a user performing Nordic hamstring curls with the workout benches disclosed herein involve the user maintaining a straight configuration where the users thighs, torso, and neck are aligned during at least a portion of the hamstring curl exercise. With the workout benches disclosed herein, a user may be more easily able to maintain the straight configuration throughout the Nordic hamstring curl.

Figure 10:
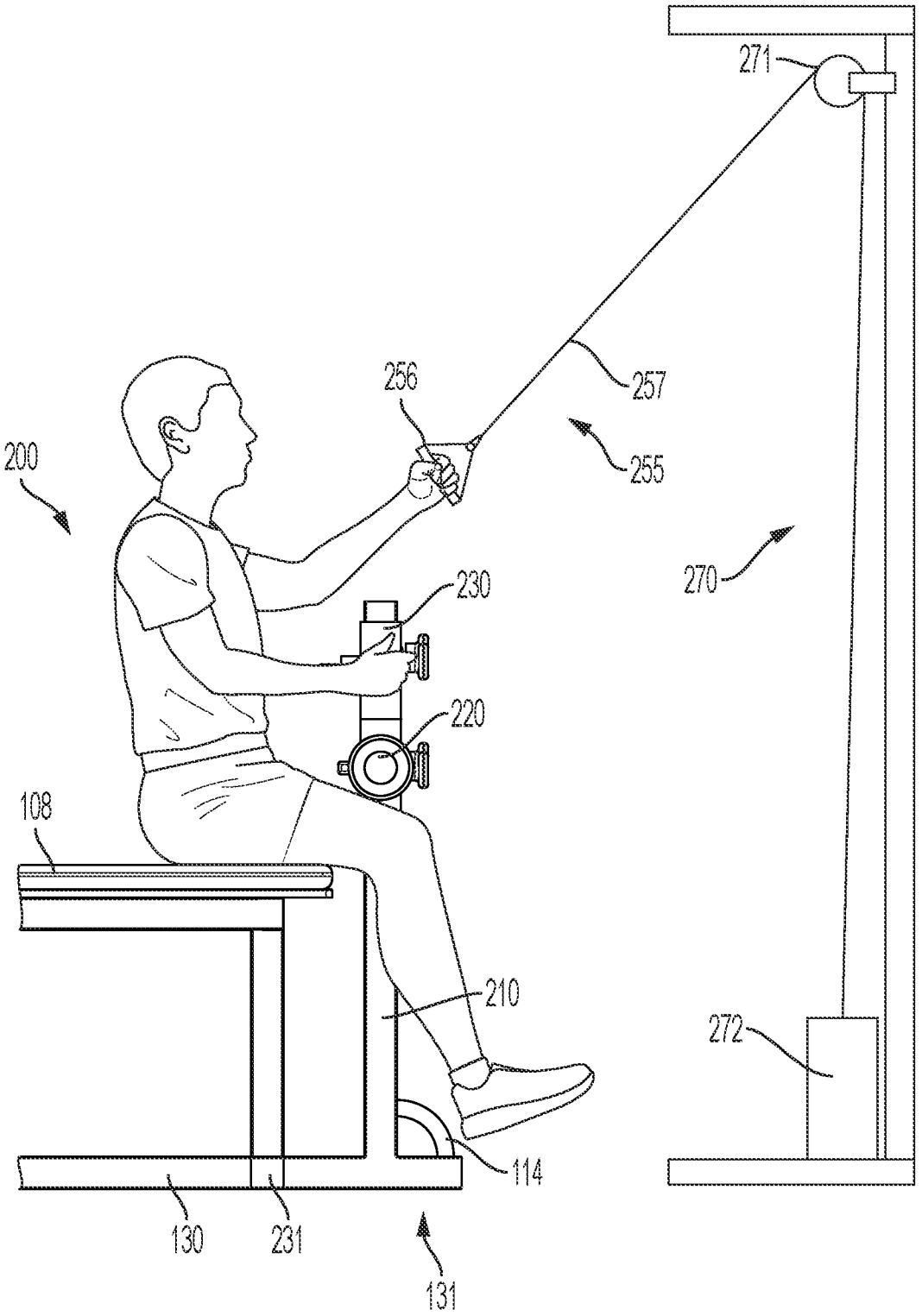
FIG. 10 illustrates a user operating the workout bench of FIG. 5 in connection with a cable weight system in a third user position, in accordance with at least one aspect of the present disclosure.

FIG. 10 illustrates another user position for the workout bench 200, in accordance with at least one aspect of the present disclosure. The user is performing an upper body resistance exercise on the exercise bench 200 by sitting on the seat pad 108, grasping the graspable handle portions 233, and repetitively pulling on a cable weight system 270. This may be referred to as arm pull downs and/or seated cable row, for example. The motion may be similar to that of rowing. The user can adjust the adjustable stabilizer pad assembly 220 so that the stabilizing pads 223 rest firmly on the user's thighs. The user can further adjust the adjustable handle assembly 230 so as to allow the non-pulling hand and arm of the user to be oriented at least substantially parallel to the seat pad 108, for example. Such an arrangement can provide a user with optimal ergonomics and leverage during this exercise. The cable weight system 270 comprises a weight 272, pulley wheels 271, and a graspable cable system 255 coupled to the weight 272. The graspable cable system 255 comprises a handle 256 and a cable 257 attached thereto. The cable 257 is attached to the weight 272 so as to provide assistance and resistance in a similar fashion as discussed above. In at least one instance, the cable weights disclosed herein may provide an assisting force to a user during a portion of the exercise and/or a resisting force to the user during the exercise.

In at least one instance, the cable weight systems discussed herein can be adjustable relative to the workout benches so as to allow a user to optimize the setup of the system. In at least one instance, a user can adjust the cable weight system and the workout bench to maximize assistance at the most difficult point of the exercise. For example, as further described herein, the workout benches comprise wheels to facilitate relocation relative to the cable weight systems and optimized positioning of the cables/pulley components during the various exercises, as further described herein.

Figure 11:
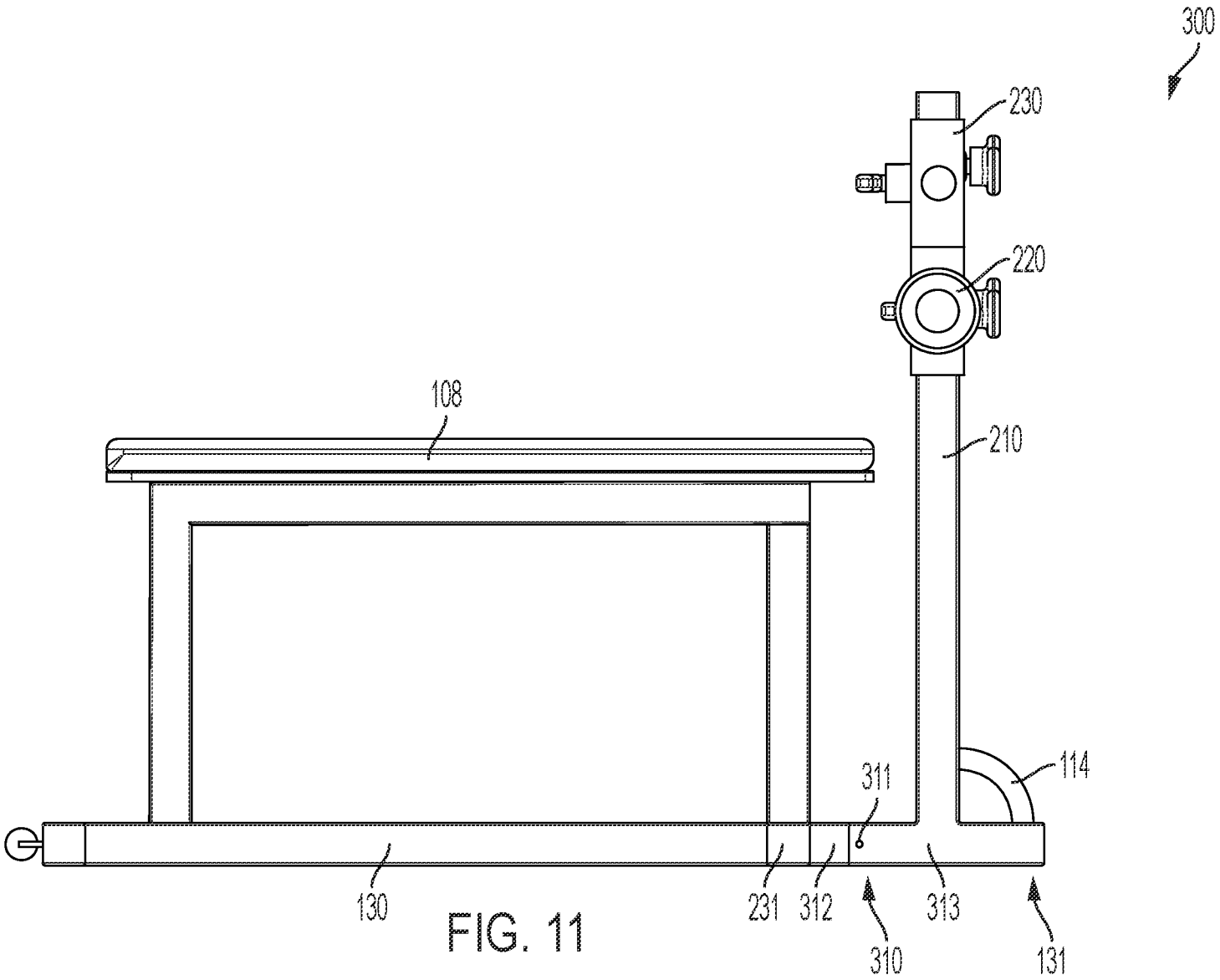
FIG. 11 is a perspective view of a workout bench comprising an adjustable handle, an adjustable stabilizer, and a modular interface in accordance with at least one aspect of the present disclosure.

FIG. 11 depicts a workout bench 300. The workout bench 300 is similar in many respects to the workout benches disclosed herein except for the differences explained below. The workout bench 300 further comprises a modular interface 310 positioned between the post 210 and the base 130 such that the seat pad 108 and portion of the base 130 can be detached, or decoupled, from the post 210 so as to allow a user to couple one or more other workout benches and/or workout component assemblies to the post 210. This modularity may provide a user with the ability to further customize a workout bench setup with the support post 210, adjustable stabilizer pad assembly 220, and adjustable handle assembly 230. The modular interface 310 comprises a pin 311 configured to permit coupling and decoupling of corresponding portions 312, 313 of the base 130 and the post 313, respectively. The pin 311 may further permit a length adjustment, for example, so as to allow the seat 108, for example, or any other suitable workout component assembly, to be positioned further away and/or closer to the support post 210. In various instances, existing workout benches can be retrofit for adaptability with the post 210 via the modular interface 310.

In at least one instance, a harness, belt, and/or strap assembly is used to attached a cable weight machine to a user. However, embodiments are envisioned where a cable machine is not used. The harness, belt, and/or strap assembly may include any suitable device which connects the user to the cable weight machine. In at least one instance, the harness assembly is connected at the head, the torso, the chest, the waist, the arms, and/or the legs, for example. The harness, belt, and/or strap assembly can be connected to the user at any suitable location. The location may vary depending on the type of exercise being performed. The harness, belt, and/or strap assembly may include a vest, a head-harness, a waist belt, and/or straps, for example.

Various aspects of the subject matter described herein are set out in the following numbered examples:

Example 1—A workout bench, comprising: a support base; an upright seat post extending from the support base; a seat supported by the upright seat post; a vertical support post extending from the support base, wherein the vertical support post comprises a plurality of height position holes; a first sliding adjustment post, comprising: a first elongated hollow center post positioned around the vertical support post and configured to guide the first sliding adjustment post along the vertical support post; a first horizontal post extending laterally from the first elongated hollow center post; a stabilizing pad positioned around at least a portion of the first horizontal post; and a first pin securing mechanism coupled to the first elongated hollow center post and the vertical support post; and a second sliding adjustment post configured to slide independent of the first sliding adjustment post, wherein the second sliding adjustment post comprises: a second elongated hollow center post positioned around the vertical support post and configured to guide the second sliding adjustment post along the vertical support post; a second horizontal post extending laterally from the second elongated hollow center post, wherein the second horizontal post comprises at least one graspable handle portion; and a second pin securing mechanism coupled to the second elongated hollow center post and the vertical support post.

Example 2—The workout bench of Example 1, wherein the second sliding adjustment post is positioned above the first sliding adjustment post.

Example 3—The workout bench of Examples 1 or 2, further comprising a modular attachment portion, wherein the modular attachment portion is configured to be attached to and detached from a corresponding workout component assembly.

Example 4—The workout bench of any one of Examples 1-3, further comprising a resistance system comprising a cable weight machine.

Example 5—A system, comprising: an exercise bench, comprising: a support base defining a centerline; an upright seat post extending from the centerline of the support base; a horizontal seat supported by the upright seat post; and a vertical support post extending from the centerline of the support base, wherein the vertical support post comprises: a plurality of height position holes; a first adjustable sliding post comprising a stabilizing pad; and a second adjustable sliding post comprising a handle, wherein the second adjustable sliding post is adjustable independently of the first adjustable sliding post; a harness comprising a strap; and a resistance system selectively coupled to the harness.

Example 6—The system of Example 5, wherein the harness comprises a vest.

Example 7—The system of Example 5 or 6, wherein the harness comprises a head-harness.

Example 8—The system of any one of Examples 5-7, wherein the strap extends between the resistance system and the harness.

Example 9—The system of any one of Examples 5-8, wherein the resistance system comprises a cable weight machine.

Example 10—A workout bench, comprising: a support base; an upright seat post extending from the support base; a seat supported by the upright seat post; a vertical support post extending from the support base, wherein the vertical support post comprises: a plurality of height position holes; and a cable connection mechanism coupled to a top of the vertical support post; and a sliding adjustment post comprising: an elongated hollow center post positioned around the vertical support post and configured to guide the sliding adjustment post along the vertical support post; a horizontal support post extending laterally from the elongated hollow center post; a stabilizing pad positioned around at least a portion of the horizontal support post; a handle extending from the horizontal support post; and a pin securing mechanism coupled to the elongated hollow center post and the vertical support post.

Example 11—The workout bench of Example 10, further comprising: a buttress style-handle extending between the vertical support post and a first end of the support base; and a wheel coupled to a second end of the support base, wherein the second end is opposite to the first end, and wherein the wheel is positioned out of contact with a level support surface when the support base is supported on the level support surface.

Example 12—The workout bench of Example 10 or 11, further comprising a cable releasably coupled to the cable connection mechanism, wherein the cable comprises a cable diameter and terminal end, wherein the cable connection mechanism comprises an interior opening that is larger than the cable diameter and is configured to allow the cable to freely pass through the cable connection mechanism, and wherein the interior opening is smaller than the terminal end of the cable and is configured to prevent the terminal end from passing through the cable connection mechanism.

Example 13—The workout bench of any one of Examples 10-12, wherein the cable connection mechanism further comprises a spring-loaded clasp, and wherein the spring-loaded clasp is configured to secure a cable to the workout bench.

Example 14—The workout bench of any one of Examples 10-13, wherein the cable connection mechanism further comprises a C-shaped open loop, and wherein the C-shaped open loop is configured to secure a cable to the workout bench.

Example 15—The workout bench of any one of Examples 10-14, wherein the seat extends longitudinally in a direction substantially parallel with the support base.

Example 16—A system, comprising: an exercise bench, comprising: a support base defining a centerline; an upright seat post extending from the centerline of the support base; a horizontal seat supported by the upright seat post; a vertical support post extending from the centerline of the support base, wherein the vertical support post comprises: a plurality of height position holes; and a connection mechanism extending from a top of the vertical support post and aligned with the centerline of the support base; wherein the system further comprises: a harness comprising a strap; and a resistance system selectively coupled to the connection mechanism and the harness.

Example 17—The system of Example 16, wherein the harness comprises a vest.

Example 18—The system of Example 16 or 17, wherein the harness comprises a head-harness.

Example 19—The system of any one of Examples 16-18, wherein the strap extends between the resistance system and the connection mechanism Example 20—The system of any one of Examples 16-19, wherein the resistance system comprises a cable weight machine.

Numerous specific details are set forth to provide a thorough understanding of the overall structure, function, manufacture, and use of the aspects as described in the present disclosure and illustrated in the accompanying drawings. Well-known operations, components, and elements have not been described in detail so as not to obscure the aspects described in the present disclosure. The reader will understand that the aspects described and illustrated herein are non-limiting examples, and thus it can be appreciated that the specific structural and functional details disclosed herein may be representative and illustrative. Variations and changes thereto may be made without departing from the scope of the claims. Furthermore, it is to be understood that such terms as "forward", "rearward", "left", "right", "upwardly", "downwardly", and the like are words of convenience and are not to be construed as limiting terms.

In the present disclosure, like reference characters designate like or corresponding parts throughout the several views of the drawings.

All patents, patent applications, publications, or other disclosure material mentioned herein, are hereby incorporated by reference in their entirety as if each individual reference was expressly incorporated by reference respectively. All references, and any material, or portion thereof, that are said to be incorporated by reference herein are incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference and the disclosure expressly set forth in the present application controls.

The present disclosure has been described with reference to various examples and illustrative aspects. The aspects described herein are understood as providing illustrative features of varying detail of various aspects of the disclosed invention; and therefore, unless otherwise specified, it is to be understood that, to the extent possible, one or more features, elements, components, constituents, ingredients, structures, modules, and/or aspects of the disclosed aspects may be combined, separated, interchanged, and/or rearranged with or relative to one or more other features, elements, components, constituents, ingredients, structures, modules, and/or aspects of the disclosed aspects without departing from the scope of the disclosed invention. Accordingly, it will be recognized by persons having ordinary skill in the art that various substitutions, modifications or combinations of any of the example aspects may be made without departing from the scope of the invention. In addition, persons skilled in the art will recognize, or be able to ascertain using no more than routine experimentation, many equivalents to the various aspects of the invention described herein upon review of the present disclosure. Thus, the present disclosure is not limited by the description of the various aspects, but rather by the claims.

While several forms have been illustrated and described, it is not the intention of Applicant to restrict or limit the scope of the appended claims to such detail. Numerous modifications, variations, changes, substitutions, combinations, and equivalents to those forms may be implemented and will occur to those skilled in the art without departing from the scope of the present disclosure. Moreover, the structure of each element associated with the described forms can be alternatively described as a means for providing the function performed by the element. Also, where materials are disclosed for certain components, other materials may be used. It is therefore to be understood that the foregoing description and the appended claims are intended to cover all such modifications, combinations, and variations as falling within the scope of the disclosed forms. The appended claims are intended to cover all such modifications, variations, changes, substitutions, modifications, and equivalents.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although claim recitations are presented in a sequence(s), it should be understood that the various operations may be performed in other orders than those which are described, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the present disclosure are not necessarily all referring to the same aspect. Furthermore, the particular features, structures or characteristics may be combined in any suitable manner in one or more aspects.

As used herein, the singular form of "a", "an", and "the" include the plural references unless the context clearly dictates otherwise.

Directional phrases used herein, such as, for example and without limitation, top, bottom, left, right, lower, upper, front, back, and variations thereof, shall relate to the orientation of the elements shown in the accompanying drawing and are not limiting upon the claims unless otherwise expressly stated.

The terms "about" or "approximately" as used in the present disclosure, unless otherwise specified, means an acceptable error for a particular value as determined by one of ordinary skill in the art, which depends in part on how the value is measured or determined. In certain aspects, the term "about" or "approximately" means within 1, 2, 3, or 4 standard deviations. In certain aspects, the term "about" or "approximately" means within 50%, 200%, 105%, 100%, 9%, 8%, 7%, 6%, 5%, 4%, 3%, 2%, 1%, 0.5%, or 0.05% of a given value or range.

In the present disclosure, unless otherwise indicated, all numerical parameters are to be understood as being prefaced and modified in all instances by the term "about," in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described herein should at least be construed in light of the number of reported significant digits and by applying ordinary rounding techniques.

Any numerical range recited herein includes all sub-ranges subsumed within the recited range. For example, a range of "1 to 100" includes all sub-ranges between (and including) the recited minimum value of 1 and the recited maximum value of 100, that is, having a minimum value equal to or greater than 1 and a maximum value equal to or less than 100. Also, all ranges recited herein are inclusive of the end points of the recited ranges. For example, a range of "1 to 100" includes the end points 1 and 100. Any maximum numerical limitation recited in the present disclosure is intended to include all lower numerical limitations subsumed therein, and any minimum numerical limitation recited in the present disclosure is intended to include all higher numerical limitations subsumed therein. Accordingly, Applicant reserves the right to amend the present disclosure, including the claims, to expressly recite any sub-range subsumed within the ranges expressly recited. All such ranges are inherently described in the present disclosure.

Any patent application, patent, non-patent publication, or other disclosure material referred to in the present disclosure and/or listed in any Application Data Sheet is incorporated by reference herein, to the extent that the incorporated materials is not inconstant herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system that "comprises," "has," "includes" or "contains" one or more elements possesses those one or more elements, but is not limited to possessing only those one or more elements. Likewise, an element of a system, device, or apparatus that "comprises," "has," "includes" or "contains" one or more features possesses those one or more features, but is not limited to possessing only those one or more features.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

What is claimed is:

1. A workout bench, comprising:

a support base including a main base member extending longitudinally from a proximal end of the workout bench to a distal end of the workout bench along a longitudinal centerline of the workout bench, a first cross support extending perpendicular to the main base member at a position toward the distal end of the workout bench from a center-point along the main base member, the first cross support having at least one wheel selectively engaged with the floor when the user lifts the proximal end of the workout bench for positioning of the workout bench, and a second cross support extending perpendicular to the main base member at a position toward the proximal end of the workout bench from a center-point along the main base member;

a first upright seat post extending from the main base member of the support base at a position toward the distal end of the workout bench from a center-point along the main base member, and a second upright seat post extending from the main base member at a position toward the proximal end of the workout bench from a center-point along the main base member;

a seat supported by the first upright seat post and the second upright seat post;

a vertical support post extending from the main base member of the support base at a position toward the proximal end of the workout bench from the second upright seat post, wherein the vertical support post comprises a plurality of height position holes;

a first sliding adjustment post adjustably coupled to the vertical support post, comprising:

i) a first hollow center post positioned around the vertical support post and configured to guide the first sliding adjustment post along the vertical support post;

ii) a first horizontal post extending laterally from the first hollow center post;

iii) a stabilizing pad positioned around at least a portion of the first horizontal post; and iv) a first pin securing mechanism coupled to the first hollow center post and the vertical support post; and a second sliding adjustment post adjustably coupled to the vertical support post and configured to slide independent of the first sliding adjustment post, wherein the second sliding adjustment post comprises:

i) a second hollow center post positioned around the vertical support post and configured to guide the second sliding adjustment post along the vertical support post;

ii) a second horizontal post extending laterally from the second hollow center post, wherein the second horizontal post comprises at least one graspable handle portion; and iii) a second pin securing mechanism coupled to the second hollow center post and the vertical support post.

2. The workout bench of claim 1, wherein the second sliding adjustment post is positioned vertically above the first sliding adjustment post on the vertical support post.

3. The workout bench of claim 1, further comprising a modular interface with a pin configured to allow the vertical support post to be attached to and detached from the main base member supporting the seat.

4. The workout bench of claim 1 further including a buttress style handle extending from the vertical support post toward the proximal end of the workout bench and coupled to the main base member.

5. The workout bench of claim 1 wherein the first cross support and the second cross support each extend laterally greater than the seat.

6. A system, comprising:

an exercise bench, comprising:

a support base including a main base member extending longitudinally from a proximal end of the exercise bench to a distal end of the workout bench along a longitudinal centerline of the exercise bench, a first cross support extending perpendicular to the main base member at a position toward the distal end of the exercise bench from a center-point along the main base member, the first cross support having at least one wheel selectively engaged with the floor when the user lifts the proximal end of the workout bench for positioning of the workout bench, and a second cross support extending perpendicular to the main base member at a position toward the proximal end of the exercise bench from a center-point along the main base member;

a first upright seat post extending from the main base member of the support base at a position toward the distal end of the exercise bench from a center-point along the main base member, and a second upright seat post extending from the main base member at a position toward the proximal end of the exercise bench from a center-point along the main base member;

a horizontal seat supported by the first upright seat post and the second upright seat post;

a vertical support post extending from the main base member of the support base at a position toward the proximal end of the workout bench from the second upright seat post, wherein the vertical support post includes a plurality of height position holes;

a first adjustable sliding post comprising a stabilizing pad configured for sliding vertical adjustment along the vertical support post;

a second adjustable sliding post comprising a handle configured for sliding vertical adjustment along the vertical support post, wherein the second adjustable sliding post is adjustable independently of the first adjustable sliding post;

a harness; and a resistance system selectively coupled to the harness wherein the resistance system is supported on a base separate and spaced from the exercise bench.

7. The system of claim 6, wherein the harness comprises a vest.

8. The system of claim 6, wherein the harness comprises a head-harness.

9. The system of claim 6, wherein the resistance system comprises a cable weight machine.

10. The system of claim 6 wherein the exercise bench further includes a modular interface with a pin configured to allow the vertical support post to be attached to and detached from the main base member supporting the seat.

11. The system of claim 6 wherein the exercise bench further includes a buttress style handle extending from the vertical support post toward the proximal end of the exercise bench and coupled to the main base member.

12. The system of claim 6 wherein in the exercise bench the first cross support and the second cross support each extend laterally greater than the seat.

13. A workout bench, comprising:

a rectangular main base member extending longitudinally from a proximal end of the workout bench to a distal end of the workout bench along a longitudinal centerline of the workout bench;

a first rectangular cross support extending perpendicular to the rectangular main base member at the distal end of the workout bench, the first cross support having at least one wheel selectively engaged with the floor when the user lifts the proximal end of the workout bench for positioning of the workout bench;

a second rectangular cross support extending perpendicular to the rectangular main base member at a position toward the proximal end of the workout bench from a center-point along the main base member;

a first upright seat post extending from the main base member of the support base at a position toward the distal end of the workout bench from a center-point along the main base member;

a second upright seat post extending from the main base member at a position aligned with the second rectangular cross support;

a seat supported by the first upright seat post and the second upright seat post;

a vertical support post extending from the main base member of the support base at a position toward the proximal end of the workout bench from the second upright seat post, wherein the vertical support post comprises a plurality of height position holes;

a first sliding adjustment post adjustably coupled to the vertical support post, comprising:

i) a first hollow center post positioned around the vertical support post and configured to guide the first sliding adjustment post along the vertical support post;

ii) a first horizontal post extending laterally from the first hollow center post;

iii) a stabilizing pad positioned around at least a portion of the first horizontal post; and iv) a first pin securing mechanism coupled to the first hollow center post and the vertical support post; and a second sliding adjustment post adjustably coupled to the vertical support post and configured to slide independent of the first sliding adjustment post, wherein the second sliding adjustment post comprises:

i) a second hollow center post positioned around the vertical support post and configured to guide the second sliding adjustment post along the vertical support post;

ii) a second horizontal post extending laterally from the second hollow center post, wherein the second horizontal post comprises at least one graspable handle portion; and iii) a second pin securing mechanism coupled to the second hollow center post and the vertical support post.

14. The workout bench of claim 13 further including a buttress style handle extending from the vertical support post toward the proximal end of the workout bench and coupled to the main base member.

15. The workout bench of claim 13 wherein the first cross support and the second cross support each extend laterally greater than the seat.

16. The workout bench of claim 13, further comprising a modular interface with a pin configured to allow the vertical support post to be attached to and detached from the main base member supporting the seat.

* * * * *